US010351277B2

(12) United States Patent
Trombetta et al.

(10) Patent No.: US 10,351,277 B2
(45) Date of Patent: Jul. 16, 2019

(54) PROCESS FOR MAKING A CAPSULE CONTAINING A DOSING AGENT

(71) Applicant: 2266170 Ontario Inc., Mississauga (CA)

(72) Inventors: Liberatore A. Trombetta, Ancaster (CA); YuCheng Fu, Mississauga (CA); Dennis Dwight Paynter, Grapevine, TX (US); Stephen Leung, Markham (CA)

(73) Assignee: 2266170 Ontario Inc., Mississauga, ON (CA)

( * ) Notice: Subject to any disclaimer, the term of this patent is extended or adjusted under 35 U.S.C. 154(b) by 359 days.

(21) Appl. No.: 15/224,706

(22) Filed: Aug. 1, 2016

(65) Prior Publication Data

US 2016/0332759 A1 Nov. 17, 2016

Related U.S. Application Data

(62) Division of application No. 14/463,949, filed on Aug. 20, 2014, now Pat. No. 9,428,329.
(Continued)

(51) Int. Cl.
*B65B 1/02* (2006.01)
*B65B 3/02* (2006.01)
(Continued)

(52) U.S. Cl.
CPC ..... *B65B 29/02* (2013.01); *B65B 1/02* (2013.01); *B65B 3/022* (2013.01); *B65B 3/10* (2013.01);
(Continued)

(58) Field of Classification Search
CPC .. B65B 3/02; B65B 3/022; B65B 3/06; B65B 3/10; B65B 7/2842; B65B 7/2878;
(Continued)

(56) References Cited

U.S. PATENT DOCUMENTS 1,951,357 A * 3/1934 Hall ..... A23F 5/125
426/103
2,113,715 A 4/1938 Wilcox
(Continued)

FOREIGN PATENT DOCUMENTS

CA 2012891 9/1991
CA 2276927 1/2000
(Continued)

OTHER PUBLICATIONS

International Search Report and Written Opinion in PCT/CA2014/050801 dated Nov. 28, 2014.

*Primary Examiner* — Stephen F. Gerrity
(74) *Attorney, Agent, or Firm* — Manelli Selter PLLC; Edward Stemberger

(57) ABSTRACT

A capsule is provided containing a dosing agent and a system and process is provided for making capsules containing a dosing agent. The capsule includes a body defining an interior space and an opening, the capsule having ingredients and a dosing agent disposed in the interior space and a cover to seal the opening. The process and system includes depositing ingredients and the dosing agent in the interior space of the capsule and then covering the opening.

23 Claims, 6 Drawing Sheets

Related U.S. Application Data

(60) Provisional application No. 61/867,819, filed on Aug. 20, 2013.

(51) Int. Cl.

| | |
|---|---|
| ***B65B 3/10*** | (2006.01) |
| ***B65B 7/28*** | (2006.01) |
| ***B65B 29/02*** | (2006.01) |
| ***B65B 29/06*** | (2006.01) |
| ***B65B 31/02*** | (2006.01) |
| ***B65D 85/804*** | (2006.01) |

(52) U.S. Cl.
CPC ..... *B65B 7/28* (2013.01); *B65B 7/2842* (2013.01); *B65B 7/2878* (2013.01); *B65B 29/06* (2013.01); *B65B 31/028* (2013.01); *B65D 85/8043* (2013.01)

(58) Field of Classification Search
CPC ..... B65B 29/02; B65B 29/022; B65B 29/06; B65B 31/02; B65B 31/025; B65B 31/028
USPC ..... 53/111 R, 511, 559, 239, 240, 267, 281
See application file for complete search history.

(56) References Cited

U.S. PATENT DOCUMENTS 2,987,221 A 6/1961 Milton
3,110,121 A 11/1963 Corrinet
3,282,703 A 11/1966 Broadhurst
3,321,887 A * 5/1967 Manas ..... B67C 3/16 141/64
3,399,806 A 9/1968 Lucas
3,509,686 A * 5/1970 Bergstrom ..... B65B 31/021 53/511
3,713,936 A 1/1973 Ramsay
3,769,032 A 10/1973 Lubsen et al.
3,917,858 A * 11/1975 Bos ..... A23F 5/48 426/285
4,024,694 A * 5/1977 Cooper et al. ..... B65B 1/02 53/131.3
4,101,627 A 7/1978 Menier
4,131,064 A 12/1978 Ryan et al.
4,220,673 A 9/1980 Strobel
4,235,160 A 11/1980 Olney et al.
4,306,367 A 12/1981 Otto
4,440,796 A 4/1984 Lunder et al.
4,471,689 A 9/1984 Piana
4,478,858 A * 10/1984 Baird et al. ..... B65D 81/18 426/126
4,518,639 A 5/1985 Phillips
4,559,729 A 12/1985 White
4,619,830 A 10/1986 Napier
4,634,598 A * 1/1987 Liu et al. ..... A23F 5/486 426/594
4,701,365 A 10/1987 Iwaski
4,728,425 A 3/1988 Sandvig
4,859,337 A 8/1989 Woltermann
4,865,737 A 9/1989 McMichael
4,867,993 A 9/1989 Nordskog
4,981,588 A 1/1991 Poulallion
4,983,410 A 1/1991 Dinos
4,995,310 A 2/1991 van der Lijn et al.
4,996,066 A 2/1991 Love et al.
5,008,013 A 4/1991 Favre et al.
5,076,433 A 12/1991 Howes
5,298,267 A 3/1994 Gruenbacher
5,331,793 A 7/1994 Pophal et al.
5,361,560 A * 11/1994 Sandolo ..... A23F 5/465 141/11
5,390,587 A 2/1995 Wu
5,399,368 A * 3/1995 Garwood et al. ..... A23F 5/486 426/307
5,447,631 A 9/1995 Mahlich
5,456,929 A 10/1995 Mifune et al.
5,496,573 A 3/1996 Tsuji et al.
5,523,112 A * 6/1996 Carns et al. ..... A23F 3/426 427/236
5,536,290 A 7/1996 Stark et al.
5,551,207 A * 9/1996 Beyer et al. ..... A23L 3/375 141/129
5,575,383 A 11/1996 Seeley
5,601,716 A 2/1997 Heinrich et al.
5,605,710 A 2/1997 Prindonoff et al.
5,688,545 A * 11/1997 Sanders ..... B65D 81/2076 426/106
5,738,786 A 4/1998 Winnington-Ingram
5,806,582 A 9/1998 Santavuori et al.
5,840,189 A 11/1998 Sylvan et al.
5,858,437 A 1/1999 Anson
5,866,185 A 2/1999 Burkett
5,871,096 A 2/1999 Yakich
5,871,644 A 2/1999 Simon et al.
5,882,716 A 3/1999 Munz-Schaerer et al.
5,885,314 A 3/1999 Oussoren et al.
5,895,672 A 4/1999 Cooper
5,896,686 A 4/1999 Howes
5,897,899 A 4/1999 Fond
5,922,384 A * 7/1999 Blackwell et al. ..... B65B 1/363 426/312
5,923,242 A 7/1999 Slagle et al.
5,927,052 A * 7/1999 Nippes et al. ..... B65B 29/02 426/410
5,932,260 A * 8/1999 Soughan ..... B65D 85/8043 210/506
5,957,279 A 9/1999 Howes
5,971,195 A 10/1999 Reidinger et al.
6,025,000 A 2/2000 Fond et al.
6,146,270 A 11/2000 Huard et al.
6,189,438 B1 2/2001 Bielfeldt et al.
6,220,147 B1 4/2001 Priley
6,223,937 B1 5/2001 Schmidt
6,440,256 B1 8/2002 Gordon et al.
6,514,555 B1 2/2003 Fayard et al.
6,548,433 B1 4/2003 Gbur et al.
6,557,597 B2 5/2003 Riesterer
6,561,232 B1 5/2003 Frutin
6,589,577 B2 7/2003 Lazaris et al.
6,607,762 B2 8/2003 Lazaris et al.
6,622,615 B2 9/2003 Heczko
6,644,173 B2 11/2003 Lazaris et al.
6,645,537 B2 11/2003 Sweeney et al.
6,658,989 B2 12/2003 Sweeney et al.
6,720,070 B2 4/2004 Hamaguchi et al.
6,758,130 B2 7/2004 Sargent et al.
6,810,788 B2 11/2004 Hale
6,841,185 B2 1/2005 Sargent et al.
6,854,378 B2 2/2005 Jarisch et al.
6,869,627 B2 3/2005 Perkovic et al.
6,913,777 B2 7/2005 Rebhorn et al.
6,959,832 B1 11/2005 Sawada
6,992,586 B2 1/2006 Rosenfeld
7,067,038 B2 6/2006 Trokhan et al.
7,153,530 B2 12/2006 Masek et al.
7,279,188 B2 10/2007 Arrick et al.
7,311,209 B2 12/2007 Bentz et al.
7,325,479 B2 2/2008 Laigneau et al.
7,328,651 B2 2/2008 Halliday et al.
7,387,063 B2 6/2008 Vu et al.
7,412,921 B2 8/2008 Hu et al.
7,444,925 B2 11/2008 Mahlich
7,490,542 B2 2/2009 Macchi et al.
7,543,527 B2 6/2009 Schmed
7,552,672 B2 6/2009 Schmed
7,552,673 B2 6/2009 Levin
7,624,673 B2 6/2009 Zanetti
7,594,470 B2 9/2009 Scarchilli et al.
7,640,842 B2 1/2010 Bardazzi
7,681,492 B2 3/2010 Suggi et al.
7,685,930 B2 3/2010 Mandralis et al.
7,698,992 B2 4/2010 Wei
7,763,300 B2 7/2010 Sargent et al.
7,798,055 B2 9/2010 Mandralis et al.

(56) References Cited

U.S. PATENT DOCUMENTS 7,854,192 B2 12/2010 Denisart et al.
7,856,920 B2 12/2010 Schmed et al.
7,856,921 B2 12/2010 Arrick et al.
7,910,145 B2 3/2011 Reati
3,062,682 A1 11/2011 Mandralis et al.
8,062,682 B2 11/2011 Mandralis
8,225,771 B2 7/2012 Aso et al.
8,286,547 B1 10/2012 Lassota
8,361,527 B2 1/2013 Winkler et al.
8,409,646 B2 4/2013 Yoakim et al.
8,425,957 B2 4/2013 Steenhof
8,474,368 B2 7/2013 Kilber et al.
8,475,854 B2 7/2013 Skalski et al.
8,481,097 B2 7/2013 Skalski et al.
8,539,743 B2 * 9/2013 Rapparini ..... B65B 29/02 53/122
8,573,114 B2 11/2013 Huang et al.
8,591,978 B2 11/2013 Skalski et al.
8,673,379 B2 3/2014 Skalski et al.
8,740,020 B2 6/2014 Marina et al.
8,834,948 B2 9/2014 Estabrook et al.
2002/0020659 A1 2/2002 Sweeney et al.
2003/0005826 A1 1/2003 Sargent et al.
2003/0039731 A1 2/2003 Dalton et al.
2003/0087005 A1 5/2003 Baron
2005/0016383 A1 1/2005 Kirschner et al.
2005/0051478 A1 3/2005 Karanikos et al.
2005/0255202 A1 * 11/2005 Dalziel et al. ..... A23F 5/14 426/302
2005/0287251 A1 12/2005 Lazaris et al.
2006/0236871 A1 10/2006 Ternite et al.
2006/0246187 A1 11/2006 Egolf et al.
2007/0144356 A1 6/2007 Rivera
2007/0148290 A1 6/2007 Ternite
2007/0275125 A1 11/2007 Catani
2008/0015098 A1 1/2008 Littlejohn et al.
2008/0142115 A1 6/2008 Vogt et al.
2008/0156196 A1 7/2008 Doglioni et al.
2008/0202075 A1 8/2008 Kronawittleithner et al.
2008/0245236 A1 10/2008 Ternite et al.
2008/0299262 A1 * 12/2008 Reati ..... B65B 29/022 426/84
2009/0110775 A1 4/2009 Rijskamp et al.
2009/0133584 A1 5/2009 De Graaff et al.
2009/0165228 A1 7/2009 Kilkenny
2009/0175986 A1 7/2009 Doglioni Majer
2009/0186141 A1 7/2009 Almblad et al.
2009/0206084 A1 8/2009 Woolf et al.
2009/0211458 A1 8/2009 Denisart et al.
2009/0260690 A1 10/2009 Bell
2009/0311389 A1 12/2009 Zoss et al.
2009/0324791 A1 12/2009 Ohresser et al.
2010/0003379 A1 1/2010 Zoss et al.
2010/0028495 A1 2/2010 Novak et al.
2010/0116772 A1 5/2010 Teys
2010/0215808 A1 8/2010 Versini
2010/0239733 A1 9/2010 Yoakim et al.
2010/0303964 A1 12/2010 Beaulieu et al.
2011/0003040 A1 1/2011 Graf et al.
2011/0020497 A1 * 1/2011 Steven et al. ..... B65D 85/8043 426/61
2011/0033580 A1 2/2011 Bieshuevel et al.
2011/0041469 A1 2/2011 Fischer et al.
2011/0045144 A1 2/2011 Boussemart et al.
2011/0076361 A1 3/2011 Peterson et al.
2011/0183048 A1 7/2011 Noble et al.
2011/0185911 A1 8/2011 Rapparini
2011/0247975 A1 10/2011 Rapparini
2012/0006205 A1 1/2012 Vanni
2012/0015094 A1 * 1/2012 Young et al. ..... A23F 5/125 426/595
2012/0024160 A1 2/2012 Van Os et al.
2012/0052163 A1 3/2012 Doleac et al.
2012/0070542 A1 3/2012 Camera et al.
2012/0097602 A1 4/2012 Tedford
2012/0121764 A1 5/2012 Lai et al.
2012/0171334 A1 7/2012 Yoakim
2012/0174794 A1 7/2012 Fraij
2012/0180670 A1 7/2012 Yoakim
2012/0180671 A1 7/2012 Baudet
2012/0183649 A1 7/2012 Burkhalter
2012/0186457 A1 7/2012 Ozanne
2012/0196008 A1 8/2012 York
2012/0199007 A1 8/2012 Larzul
2012/0199010 A1 8/2012 Mariller
2012/0199011 A1 8/2012 Cheng
2012/0201933 A1 8/2012 Dran et al.
2012/0207893 A1 8/2012 Kreuger
2012/0207894 A1 8/2012 Webster
2012/0210876 A1 8/2012 Glucksman
2012/0210878 A1 8/2012 Mariller
2012/0210879 A1 8/2012 Mariller
2012/0231123 A1 9/2012 Kamerbeek
2012/0231124 A1 9/2012 Kamerbeek
2012/0231126 A1 9/2012 Lo Faro
2012/0231133 A1 9/2012 Kamerbeek
2012/0251668 A1 10/2012 Wong
2012/0251669 A1 10/2012 Kamerbeek
2012/0251670 A1 10/2012 Kamerbeek
2012/0251671 A1 10/2012 Kamerbeek
2012/0251692 A1 10/2012 Kamerbeek
2012/0251693 A1 10/2012 Kamerbeek
2012/0251694 A1 10/2012 Kamerbeek
2012/0258204 A1 10/2012 Tsuji
2012/0258210 A1 10/2012 Wong
2012/0258219 A1 10/2012 Wong
2012/0258221 A1 10/2012 Wong
2012/0260806 A1 10/2012 Rolfes
2012/0263829 A1 10/2012 Kamerbeek
2012/0263830 A1 10/2012 Kamerbeek
2012/0263833 A1 10/2012 Wong
2012/0266755 A1 10/2012 Baudet
2012/0269933 A1 10/2012 Rapparini
2012/0272830 A1 11/2012 Gugerli
2012/0276252 A1 11/2012 Bunke
2012/0276255 A1 11/2012 Verbeek
2012/0297987 A1 11/2012 Lee
2012/0301581 A1 11/2012 Abegglen
2012/0307024 A1 12/2012 Howes
2012/0308688 A1 12/2012 Peterson
2012/0312174 A1 12/2012 Lambert
2012/0321755 A1 12/2012 Macaulay
2012/0321756 A1 12/2012 Estabrook et al.
2012/0328739 A1 12/2012 Nocera
2012/0328740 A1 12/2012 Nocera
2012/0328744 A1 12/2012 Nocera
2013/0004629 A1 1/2013 Clark
2013/0004637 A1 1/2013 Gugerli
2013/0008316 A1 1/2013 Hoeglauer
2013/0011521 A1 1/2013 Weijers et al.
2013/0017303 A1 1/2013 Vu
2013/0025466 A1 1/2013 Fu
2013/0032034 A1 2/2013 Jarisch
2013/0047863 A1 2/2013 Larzul
2013/0059039 A1 3/2013 Trombetta
2013/0059903 A1 3/2013 Raman et al.
2013/0068109 A1 3/2013 Pribus et al.
2013/0071532 A1 * 3/2013 Pribus et al. ..... B65D 85/8043 426/431
2013/0084368 A1 4/2013 Linck et al.
2013/0095219 A1 4/2013 de Graaff et al.
2013/0115342 A1 5/2013 Van Os et al.
2013/0122153 A1 5/2013 Ferrier et al.
2013/0122167 A1 5/2013 Winkler et al.
2013/0142931 A1 6/2013 Fin et al.
2013/0259982 A1 10/2013 Abegglen et al.
2013/0340626 A1 12/2013 Oh
2013/0344205 A1 12/2013 Oh
2014/0013958 A1 1/2014 Krasne et al.
2014/0017359 A1 * 1/2014 Kruger et al. ..... B65D 85/8043 426/78
2014/0037802 A1 2/2014 Cardoso
2014/0099388 A1 4/2014 Wang et al.

(56) References Cited

U.S. PATENT DOCUMENTS

| | | | | |
|---|---|---|---|---|
| 2014/0161940 | A1* | 6/2014 | Aviles et al. | B65D 85/8043 426/115 |
| 2014/0230370 | A1* | 8/2014 | Bianchi | B65B 29/02 53/410 |
| 2014/0370181 | A1* | 12/2014 | Young | B65D 85/8043 426/595 |
| 2015/0050391 | A1 | 2/2015 | Rapparini | |
| 2015/0166204 | A1* | 6/2015 | Rea et al. | B65B 29/02 53/452 |

FOREIGN PATENT DOCUMENTS

| | | | | |
|---|---|---|---|---|
| CA | 2516417 | A1 | 9/2004 | |
| CA | 2689804 | A1 | 3/2008 | |
| CA | 2686347 | A1 | 12/2008 | |
| CA | 2807489 | | 2/2012 | |
| CA | 2824199 | A1 | 8/2012 | |
| CA | 2759782 | A1 | 11/2012 | |
| CN | 202537195 | | 11/2012 | |
| CN | 202960136 | | 6/2013 | |
| EP | 0008015 | A1 * | 2/1980 | A23F 5/48 |
| EP | 0047169 | A2 | 3/1982 | |
| EP | 0145499 | | 6/1985 | |
| EP | 0432126 | A1 | 6/1991 | |
| EP | 1208782 | | 8/2004 | |
| EP | 1527699 | A1 * | 5/2005 | B65B 3/06 |
| EP | 1593329 | | 11/2005 | |
| EP | 1859683 | | 11/2007 | |
| EP | 2230195 | | 9/2010 | |
| EP | 2345351 | | 7/2011 | |
| EP | 2409608 | | 1/2012 | |
| EP | 2484605 | A1 * | 1/2012 | B65B 29/022 |
| EP | 2412645 | A1 * | 2/2012 | B65B 29/02 |
| EP | 2484605 | | 8/2012 | |
| EP | 2551216 | A1 * | 1/2013 | B65B 29/022 |
| FR | 2930522 | A1 | 10/2009 | |
| GB | 803486 | | 10/1958 | |
| GB | 962038 | | 6/1964 | |
| GB | 2068327 | A * | 8/1981 | B65B 9/042 |
| GB | 2074838 | | 11/1981 | |
| JP | 662737 | | 3/1994 | |
| JP | 11171249 | A | 6/1999 | |
| KR | 20140031693 | | 3/2014 | |
| WO | 0145616 | A1 | 6/2001 | |
| WO | 03082065 | A1 | 10/2003 | |
| WO | 2004083071 | A1 | 9/2004 | |
| WO | 2204/112556 | | 12/2004 | |
| WO | 2009114119 | | 9/2009 | |
| WO | 2010013146 | A2 | 2/2010 | |
| WO | 2010066705 | | 6/2010 | |
| WO | 2010085824 | | 8/2010 | |
| WO | 2010106516 | A1 | 9/2010 | |
| WO | 2010137956 | A1 | 12/2010 | |
| WO | 2011095518 | | 8/2011 | |
| WO | 2012031106 | A1 | 3/2012 | |
| WO | 2012069505 | | 5/2012 | |
| WO | 2014056862 | | 4/2014 | |

* cited by examiner

PROCESS FOR MAKING A CAPSULE CONTAINING A DOSING AGENT

This application is a division of U.S. application Ser. No. 14,463,949 filed on Aug. 20, 2014, which claims the benefit for priority purposes of U.S. Provisional Application No. 61/867,819, filed on Aug. 20, 2013.

FIELD

This specification relates to capsules containing dosing agents for preparing a desired consumable product and systems and processes for making same.

BACKGROUND

The following background discussion is not an admission that anything discussed below is citable as prior art or common general knowledge. The documents listed below are incorporated herein in their entirety by this reference to them.

Capsules for use in machines to prepare a desired consumable product are becoming increasingly popular. Such capsules come in a variety of formats containing ingredients for producing consumable products such as coffee, tea, hot chocolate or soup.

Capsule machines typically include an injection system for injecting a fluid, such as hot water, into a capsule for mixing with ingredients disposed within the capsule to prepare a desired consumable product. A dispensing system may also be provided to dispense the prepared product from the capsule for delivery to a receptacle such as a user's cup or bowl.

A problem with conventional capsules is that it can be difficult to control the manner in which ingredients are exposed to fluid that is injected into the capsule. It may be desirable for example for certain ingredients to be mixed with fluid within the capsule for a longer period of time than other ingredients. It may also be desirable for certain ingredients to be separated from other ingredients within the capsule prior to, or for a desired period following, injection of fluid into the capsule.

Another problem with conventional capsules is that the fluid injected into the capsule may form one or more channels through the ingredients contained within the capsule along one or more axes of injection. This can result in fluid being dispensed from the capsule prior to adequately mixing with ingredients.

Furthermore, some ingredients may not be sufficiently saturated with fluid to optimize the preparation of the desired product.

It is known to provide permanent structural elements within a capsule to manage the flow of fluid that is injected into the capsule. A problem with permanent structural elements is that they add to the cost and complexity of manufacturing the capsule. Permanent structural elements may also occupy space within the capsule which may be better utilized for other purposes.

It is desirable on occasion that a dosing agent, such as a flavoring component, is added to the capsule to produce a desired consumable product. Dosing agents are typically mixed with ingredients in large totes prior to loading the mixture into capsules.

A problem with this system is that a large number of totes are required in order to have an inventory of different mixtures to produce a desired batch of capsules. Alternatively, if only one or a few totes were available, the tote or totes need to be thoroughly cleaned after each use to prevent mixing of dosing agents.

There is a need for an improved capsule and an improved system and process for making capsules with a desired dosing agent.

SUMMARY OF THE DISCLOSURE

In one aspect, there is provided a process for making a capsule for use in a machine for preparing consumable products from capsules, the process comprising the steps of:

providing a body having an interior space and an opening;

depositing ingredients that are in a dry state into the interior space, the ingredients being adapted to form a consumable product when combined with fluid;

dispensing a dosing agent that is in a liquid state into the interior space; and sealing the opening with a cover.

In another aspect, there is provided a system for making a capsule for use in a machine for preparing consumable products from capsules, the system comprising:

an ingredient station for depositing ingredients that are in a dry state into a body for the capsule, said body having an interior space and an opening, the ingredients being adapted to form a consumable product when combined with fluid;

a dosing agent station for dispensing a dosing agent that is in a liquid state into the interior space of the capsule; and a cover sealing station for sealing a cover over the opening.

In another aspect, there is provided a capsule made according to the above described process.

In another aspect, there is provided a capsule, for use in a machine for preparing consumable products from capsules, said capsule comprising:

a. a body defining an interior space with an opening;

b. a filter disposed in said interior space to define an ingredients chamber, said filter being adapted for filtering ingredients during preparation of said consumable product;

c. a dosing agent disposed on a portion of said filter for controlling the flow of fluid through said filter;

d. ingredients disposed in said ingredients chamber for preparing a desired consumable product; and e. a cover disposed over said opening.

In another aspect there is provided a capsule, for use in a machine for preparing consumable products from capsules, said capsule comprising:

a. a body defining an interior space with an opening;

b. ingredients disposed in said interior space for preparing a desired consumable product;

c. a dosing agent disposed in said interior space with said ingredients, wherein a portion of said ingredients and said dosing agent are non-permanently bound to form a cluster for controlling the flow of fluid through said filter; and d. a cover disposed over said opening.

Other aspects and features of the teachings disclosed herein will become apparent to those ordinarily skilled in the art upon review of the following description of specific examples and the accompanying drawings.

BRIEF DESCRIPTION OF THE DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Figure 1:
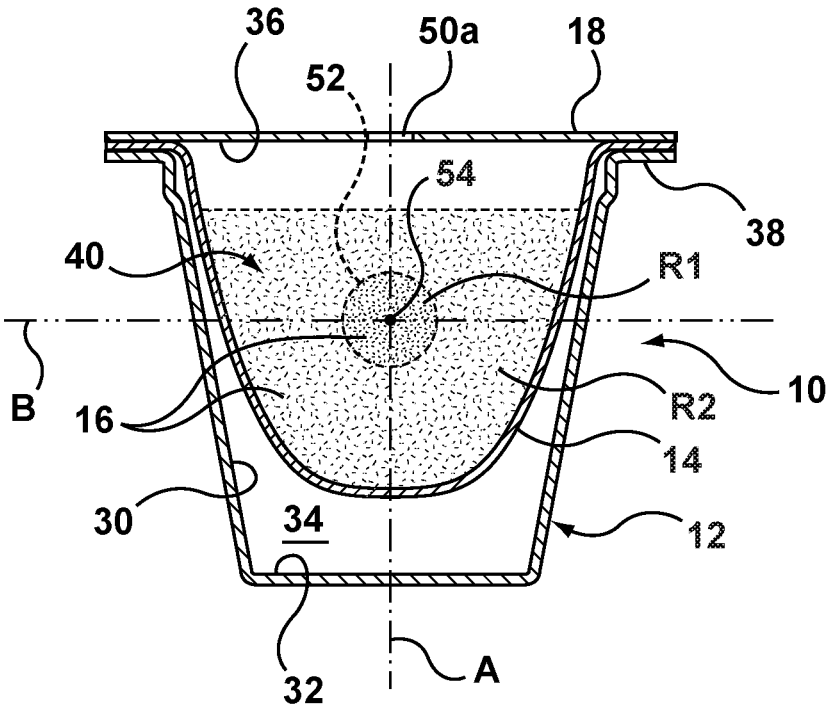
FIG. 1 is a vertical cross-section of a capsule containing a dosing agent.
Figure 2:
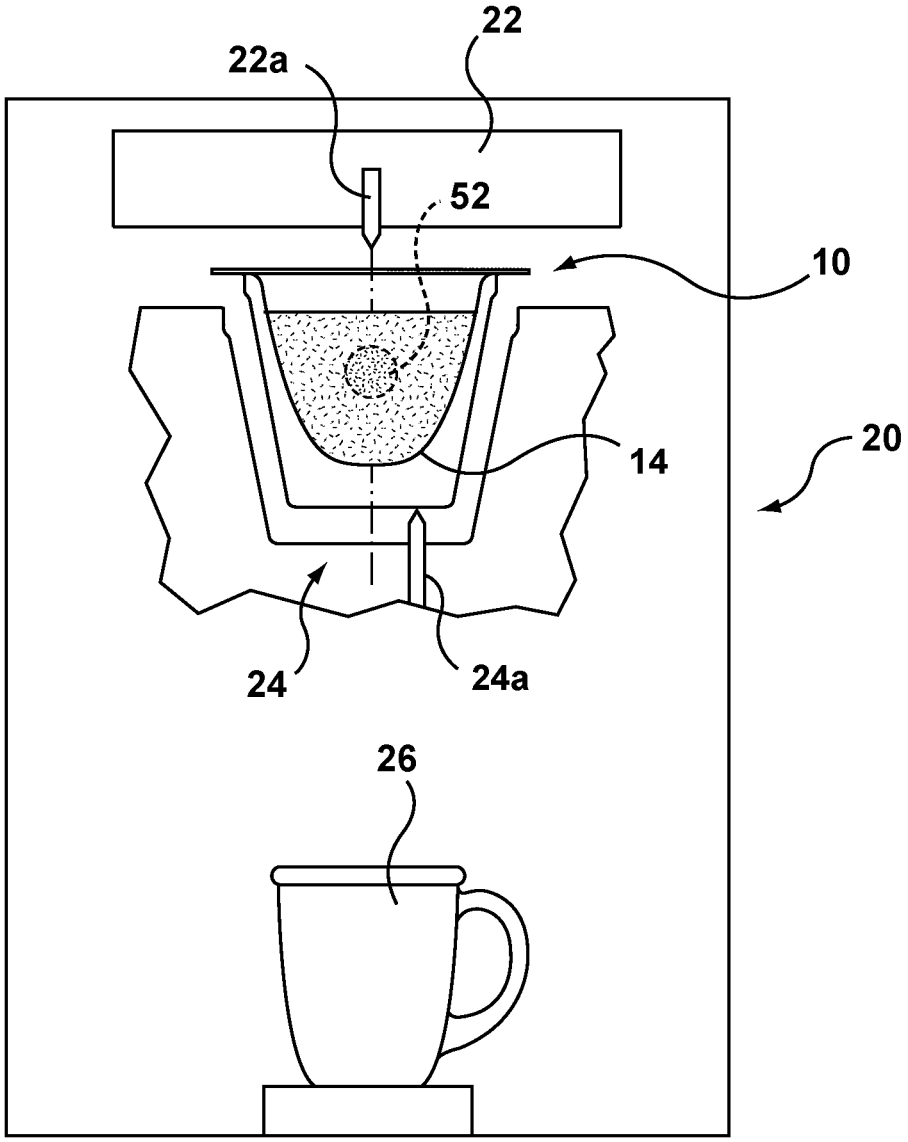
FIG. 2 is schematic view of a machine for preparing consumable products from capsules.

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A capsule in accordance with the present invention is shown generally at 10 in the figures. Capsule 10 includes a body 12, filter 14 (when required), ingredients 16 and cover 18. Capsule may be sized to provide a single serving of a desired product or multiple servings.

Ingredients 16 include soluble and/or insoluble ingredients that are a precursor to forming a desired product when combined with fluid as described further below. Preferably, ingredients 16 are provided in a dry state. Soluble ingredients may include instant coffee, chocolate, soup stock or other ingredients in powdered, crystallized or other forms adapted for solubility or contained within a soluble film or pouch. Insoluble ingredients may include tea leaves, coffee grounds, herbs or other ingredients adapted for forming a consumable product by extraction or infusion. Ingredients 16 may also include active ingredients (e.g., foaming agents), natural health additives, regulated drugs, alcohol or other soluble or insoluble ingredients.

Ingredients 16 may be disposed in a plurality of distinct regions R1, R2 . . . Rn within capsule 10. The same type of ingredients 16 may be disposed in each region R or different types of ingredients 16 may be disposed in different regions R. The density, cohesion or other physical properties of ingredients 16 may also vary between regions R.

Capsule 10 is sized and configured for use in a machine 20 that is adapted for preparing a product from capsule 10. Machine 20 may include an injection system 22 for injecting a fluid, typically heated water, into the capsule for mixing with ingredients 16. Injection system 22 may include a nozzle 22*a* disposed on machine 20 that is adapted to pierce cover 18 to inject fluid into capsule 10. Injection system 22 may alternatively have at least one component disposed on capsule 10, such as on cover 18, and adapted to pierce body 12 and interact with machine 20 to inject fluid into capsule 10.

Machine may also include a dispensing system 24 for dispensing product from capsule 10 into a desired receptacle 26 such as a bowl or cup. Dispensing system 24 may include a hollow probe 24*a* that is adapted to pierce capsule 10 to dispense a prepared product from capsule 10.

Body 12 of capsule 10 includes a sidewall 30 and an end wall 32 together defining an interior space 34. An opening 36 is defined at one end of body 12 and a flange 38 extends around the perimeter of opening 36 to receive cover 18 and to support capsule 10 within machine 20.

In another embodiment, body 12 may be formed with no end wall 32 and no sidewall 30 or a partial sidewall 30. Flange 38 may still extend around the perimeter of opening 36 to receive cover 18 and to support capsule 10 within machine 20. Filter 14 may be secured to flange 38 or to partial sidewall 30.

Filter 14 is adapted to be disposed within body 12 to define at least one ingredients chamber for receiving one or more ingredients 16 and in particular insoluble ingredients 16 that are not intended to be dispensed into receptacle 26 (for example coffee grounds or tea leaves).

Filter 14 is preferably adapted to be phobic to the fluid being injected into capsule 10. In most instances, the fluid will comprise water (either heated or cooled) and a hydrophobic filter 14 is desired. Filter 14 may be formed of materials that are phobic to fluid such as polyolefins (e.g., polyethylene, polypropylene) and mixtures of polyolefins with other polymers or filter 14 may be coated with materials that are phobic to fluid such as a polyethylene coating.

Preferably, filter 14 is formed of a moldable non-woven filtration material that includes a plurality of multi-component fibers that are bound or interlocked by non-woven manufacturing techniques (such as spun bond techniques) to form a web having channels extending from one side of filter 14 to the other. The desired diameter for channels after forming is between 20 and 100 μm, more preferably between 40 to 80 μm. More details of a preferred filtration material for filter 14 are provided in US patent publication 20140127364 which is hereby incorporated in its entirety herein by reference.

Filter 14 may be secured to flange 38 or to an interior surface of capsule 10 (such as to sidewall 30). Capsule 10 may be provided without filter 14 in instances where ingredients are soluble or where it is desired that insoluble ingredients 16 are dispensed together with fluid into receptacle 26 (this requires that dispensing system be adapted to dispense insoluble ingredients 16).

Cover 18 is disposed over opening 36 and secured to body 12 such as by sealing cover 18 directly to flange 38 or indirectly with a portion of filter 14 located between as described in US patent publication 20130209618 which is incorporated herein in its entirety by reference.

A dosing agent 40, preferably in a liquid state, is disposed within capsule 10 by means of a dispenser 50 (see FIG. 3) prior to completion and sealing of capsule 10 as described further below. Dosing agent 40 may be a neutral dosing agent 40*a* or it may be an active dosing agent 40*b*. A neutral dosing agent 40*a* does not add any noticeable flavor, odour, sensory, health benefit or function to the consumable product produced from capsule 10 but may combine with a portion of ingredients 16 to form a cluster 52 inside capsule 10 as described further below. Examples of neutral dosing agent 40*a* include polyethylene glycol, polypropylene glycol, ethyl alcohol etc. Conversely, an active dosing agent 40*b* provides a flavor, odour, sensory, health benefit or function to the consumable product and may also combine with a portion of ingredients 16 to form cluster 52. Examples of active dosing agents 40*b* include flavor components such as Ethyl-2-methybutyrate (apple), 1-octen-3-ol, (mushroom), p-menthene-8-thiol (Grapefruit) or 5-methyl-2-hepten-4-one (Hazelnut). Active dosing agent 40*b* is employed either directly at a high concentration or diluted with a neutral dosing agent 40*a*. Both neutral and active dosing agents are preferably highly water soluble.

In one embodiment, dosing agent 40 is applied to ingredients 16 disposed in capsule 10 in a manner that creates a cluster 52 formed of an agglomeration of a portion of ingredients 16 and dosing agent 40. Cluster 52 may be formed as a clump or as a layer or crust formed of dosing agent 40 and ingredients 16. Cluster 52 comprises a non-permanent structure that is adapted to at least partially dissolve or break apart within capsule 10 when exposed to a flow of fluid over a period of time (such as the period of time required to inject the desired amount of fluid into capsule 10). In one embodiment of the capsule 10, the main beverage ingredient is ground coffee and dosing agent 40 is in the form of an oil or an oil-like product.

Cluster 50 may comprise a first region R1 of ingredients 16 and dosing agent 40 disposed within capsule 10. The remainder of ingredients 16 for capsule 10 may comprise a second region R2 of capsule 10. Second region R2 may partially or fully surround first region R1. Ingredients 16 in second region R2 may be loosely disposed within capsule 10 while ingredients 16 and dosing agent 40 in first region R1 are formed into cluster 52.

As shown in FIG. 1, cluster 52 is preferably disposed at a desired location 54 within capsule 10 that is adapted for controlling the flow of fluid injected into capsule 10. Such fluid control may comprise dispersing a flow of fluid for a period of time, absorbing a flow of fluid for a period of time or otherwise controlling or altering the flow of fluid within capsule 10. Location 54 may be selected according to the type of capsule machine 20 and injection system 22 for which capsule 10 is intended to be used as well as the type of ingredients 16 disposed within capsule 10. Location 54 for K-cup™ brewers for example may be along a central axis A of capsule 10 in line with the flow of fluid that is injected into capsule 10 through injection nozzle 22*a*. Alternatively, location 54 may be along a transverse axis B where cluster 52 is formed as a layer or crust. In some instances it may be desirable for location 54 to be at a lower portion of capsule 10 and in other instances in may be preferable for location 54 to be at an upper location of capsule 10.

Figure 3:
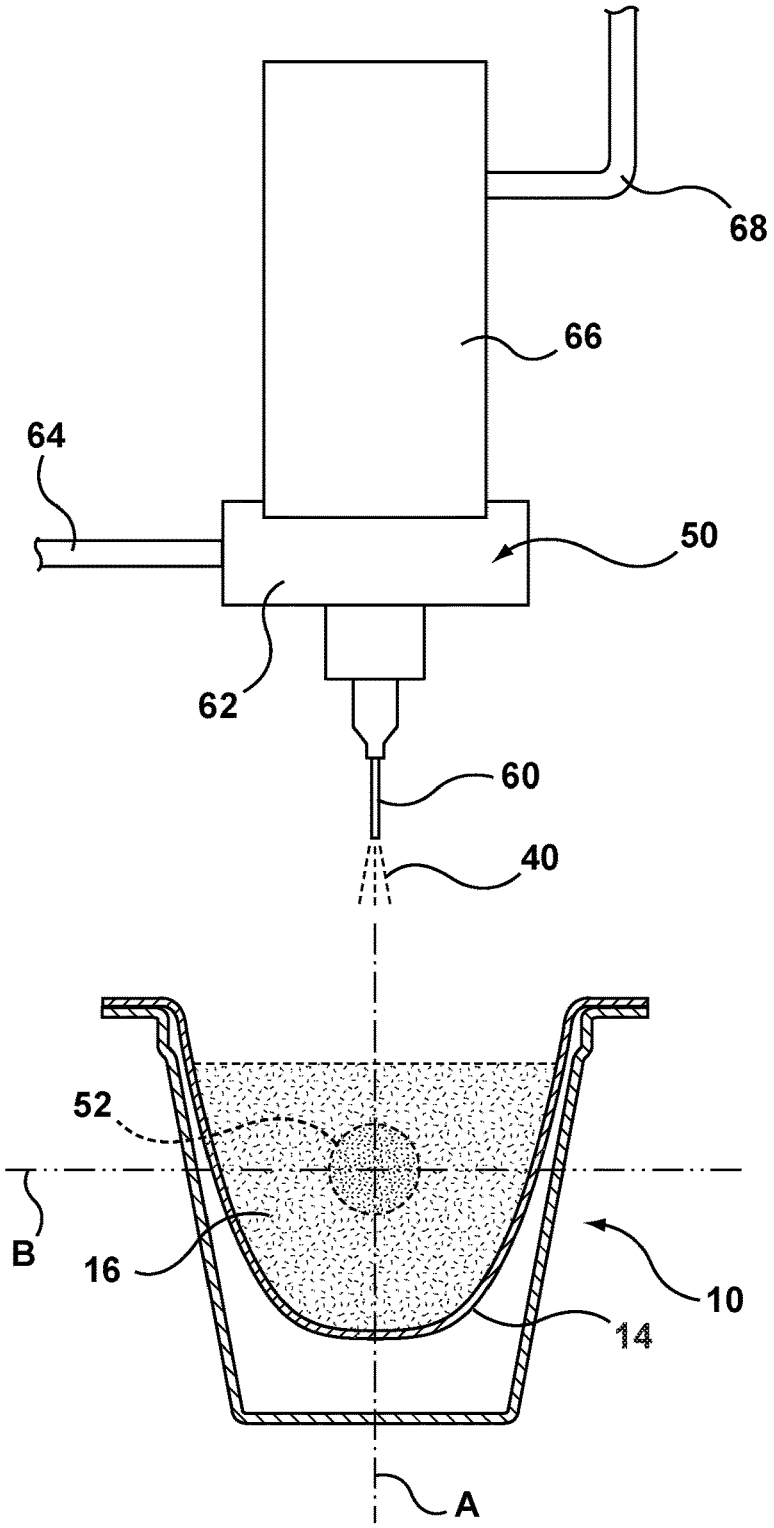
FIG. 3 is a schematic view of a dispenser for dispensing a dosing agent into a capsule.

Referring to FIG. 3, dispenser 50 comprises a device for dispensing dosing agent 40 in a desired manner and location within capsule 10. In one embodiment, dispenser 50 comprises a nozzle 60, a fluid body 62, a fluid inlet 64, a gas cylinder body 66 and a gas inlet 68 for dispensing a mix of dosing agent 40 and a gas into capsule 10. Fluid body 62 is adapted to receive dosing agent 40 through fluid inlet 64 from a dosing agent supply tank (not shown). Gas cylinder body 66 is adapted to receive a desired gas through gas inlet 68 from a gas supply tank (not shown). Gas and dosing agent 40 are mixed within dispenser 50 and dispensed as a pressurized stream or spray through nozzle 60. In other embodiments, dispenser 50 may dispense dosing agent 40 through nozzle 60 without mixing with a source of gas. In such embodiments, dispenser 50 comprises a fluid body 64 and fluid inlet 64 connected to nozzle 60.

Dosing agent 40 may be applied to ingredients 16 by inserting nozzle 60 partway into ingredients 16 to form cluster 52. Alternatively, dosing agent 40 may be dispensed under pressure over the surface of ingredients 16 without inserting nozzle 60 into ingredients 16. This latter approach avoids direct contact between nozzle 60 and ingredients 16. Dispensing dosing agent 40 under a desired pressure over the surface of ingredients 16 still allows cluster 52 to be formed at a desired location 54 based on factors such as the dispensing pressure of dosing agent 40 and the density of ingredients 16. Alternatively, dosing agent 40 may be applied by dispenser 50 to filter 14 or sidewall 30 or endwall 32 of capsule 10 prior to adding ingredients 16. Alternatively, capsule 10 may be partially filled with ingredients 16 and then dosing agent 40 may be applied to ingredients 16 and then the remaining ingredients 16 may be added to capsule.

Figure 4:
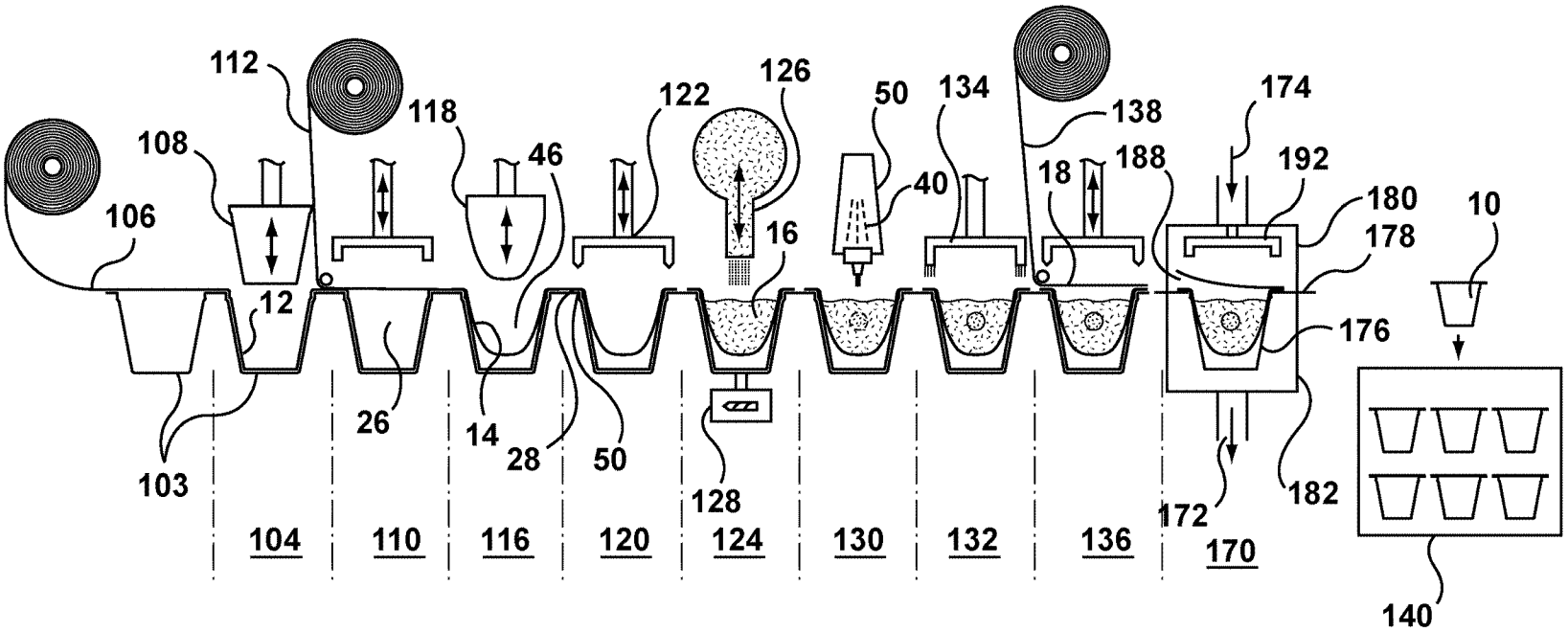
FIG. 4 is a schematic view of a system for making capsules containing a dosing agent.
Figure 5:
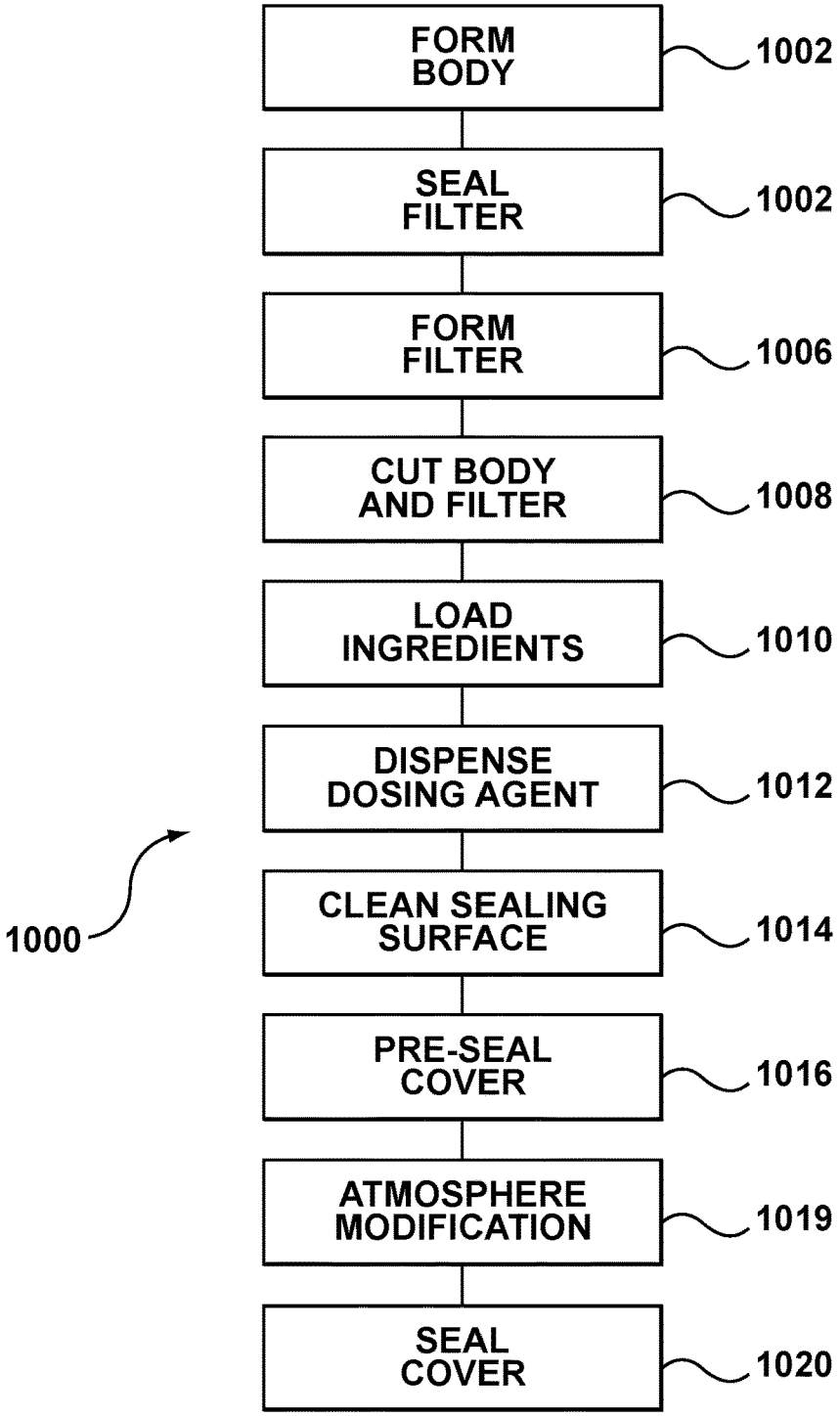
FIG. 5 is a diagram of a process for making capsules containing a dosing agent.

Referring to FIGS. 4 and 5, schematic views of a system 100 and a process 1000 for making capsules 10 is shown.

System 100 comprises at least one transfer belt 102 having a plurality of capsule holders 103 adapted to cyclically and sequentially transfer capsules 10 from a working station to a following station as described further below. While only a single capsule holder 103 is shown at each station for system 100 it will be understood that transfer belt 102 has multiple capsule holders 103 disposed at each station in order that manufacturing operations may be performed simultaneously on multiple capsules at each station.

System 100 includes a body forming station 104 for engaging a sheet of moldable multilayered body material 106 with a heated mandrel 108 to form body 12 in accordance with body forming step 1002. Capsule holder 103 with body 12 formed in body material 106 is then transferred to a filter sealing station 110 (if a filter 14 is desired, otherwise capsule holder 103 with body 12 is transferred directly to cutting station 120 as described below). A sheet of moldable nonwoven filter material 112 is sealed to body material 106 at filter sealing station 110 in accordance with filter sealing step 1004 such that filter material 112 covers opening 26 of body 12.

Capsule holder 103 with filter material 112 sealed to body material 106 is then transferred to a filter forming station 116 where a heated mandrel 118 engages the portion of filter material 112 that extends over opening 26 of body 12 to form a filter 14 into a desired shape to define an ingredients chamber 46 within thermoformed body 12 in accordance with filter forming step 1006.

Capsule holder 103 with filter material 112 sealed to body material 106 and filter 14 formed in body 12 is then transferred to a cutting station 120 where a die 122 cuts each individual body 12 with filter 14 from body material 106 in accordance with cutting step 1008. Die 122 is adapted to cut body material 106 to define flange 28 around opening of body 12 with a gasket portion of filter 14 sealed to the top surface of flange 28.

Capsule holder 103 with separated body 12 with filter 14 is then transferred to an ingredients station 124 having an ingredients supplier 126 for supplying a desired amount of ingredients 16 into ingredients chamber 46 in accordance with ingredients loading step 1010. A scale 128 weighs beverage capsule 10 to ensure that the desired amount of ingredients 16 have been disposed into ingredients chamber 46.

Capsule holder 103 then transfers body 12 with filter 14 and ingredients 16 to dosing agent station 130 having a dispenser 50 for dispensing a desired amount of dosing agent 40 into ingredients 16 in accordance with dosing step 1012.

A desired amount of liquid dosing agent 40 for a single serve capsule having 8-10 grams of dry ingredients 16 is in the range of 0.2-2.0 cc. Dosing agent 40, alone or in combination with a gas, can be expelled through nozzle 60 of dispenser 50 into capsule 10. Typically the gas is an inert gas such as nitrogen, not air, in view of the need to keep oxygen away from certain types of ingredients 16 such as roasted ground coffee. In one embodiment, for producing capsules 10 containing loosely filled dry ground coffee or tea, dosing agent 40 is delivered under pressure at a preferred range of 10-50 psi and the dosing time is approximately 0.1 to 0.2 seconds. The amount of dosing agent 40 that is dispensed can be adjusted through varying the orifice size of the nozzle 60, through controlling the time of injection and/or through controlling pressure.

Following dosing step 1012, capsule holder 103 then transfers body 12 with filter 14 and ingredients 16 with dosing agent 40 to cleaning station 132 where a vacuum conduit 134 cleans the exposed surface of flange 28 or gasket portion 50 of filter 14 in preparation for sealing with cover 18 in accordance with cleaning step 1014.

Capsule holder 103 then transfers body 12 with filter 14 and ingredients 16 with dosing agent 40 to a cover pre-sealing station 136 for receiving a supply of a cover material 138 and pre-sealing a portion of cover 18 to gasket portion 50 of filter 14 and to flange 28 of body 12 in accordance with pre-sealing step 1016. Cover pre-sealing station 136 leaves openings 188 along edge of cover 18 for allowing air to be evacuated and inert gas to be flushed into capsule during the modified atmosphere packaging (MAP) process step 1018 as described in more detail below.

Partially sealed capsules 10 are then transferred from capsule holders 103 in transfer plate 102 to corresponding capsule holders 176 disposed within a transfer plate 178 using a pick-and-place device (not shown) or other suitable mechanism. Capsule holders 176 and transfer plate 178 are specially adapted for use during the MAP process step 1018.

Transfer plate 178 with partially sealed beverage capsules 10 disposed in capsule holders 176 is then moved to a MAP station 170 for execution of the MAP process step 1018 as described in more detail in US patent publication 20140141128 which is incorporated herein in its entirety by reference. Once the MAP process is complete, openings 188 in cover 18 are sealed with sealer 192 in accordance with sealing step 1020 and the finished capsule 10 is transferred using a pick-and-place device (not shown) or other suitable mechanism to a collection station 140 for subsequent packaging into boxes (not shown).

It will be understood that system 100 and process 1000 do not require all stations and steps to be provided. It will also be understood that the relative position of stations or the order of process steps may be changed depending on the desired structure and contents of the finished capsule 10.

Figure 6:
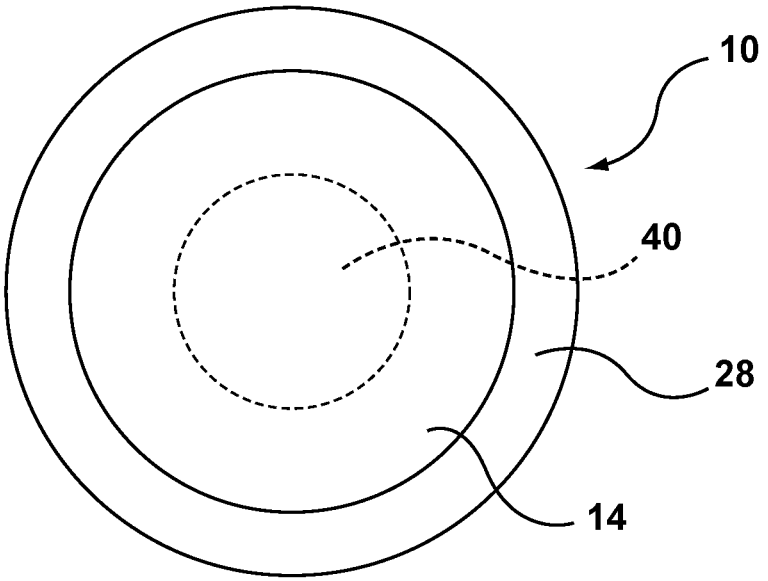
FIG. 6 is a top view of a capsule without ingredients showing a dosing agent applied to a portion of the filter.

For example, dosing agent 40 may be sprayed by means of dispenser 50 onto filter 14 as shown in FIG. 6 before ingredients 16 are loaded into capsule. Dosing agent 40 may be selected to provide a layer over a portion of filter to control the flow of fluid through filter. Dosing agent 40 may be formed of a soluble or insoluble material depending on how one wishes to control the flow of fluid through filter.

Figure 7:
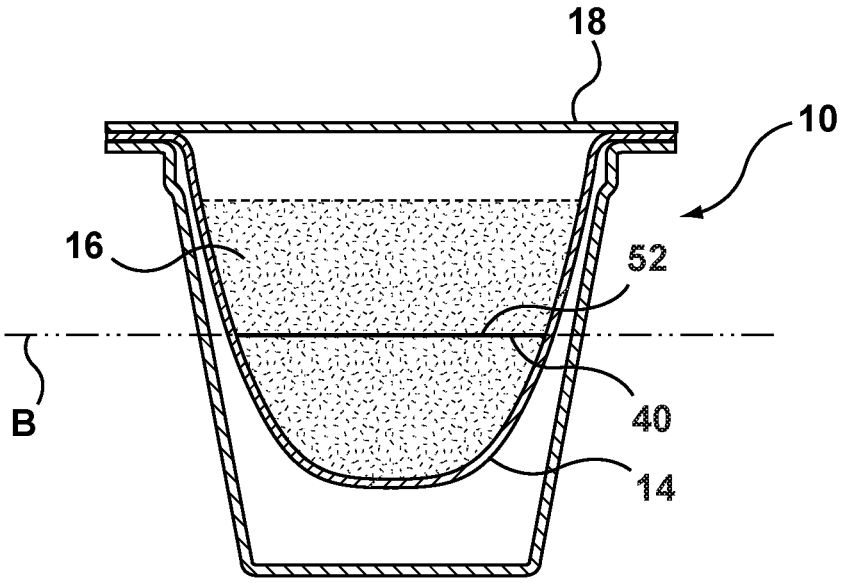
FIG. 7 is a sectional view of a capsule having a cluster formed as a layer within the ingredients.

In another example, dosing agent 40 may be applied to the surface of ingredients 16 that are loaded into capsule 10 to form cluster 52 as a layer or crust of agglomerated ingredients 16. As shown in FIG. 7, a portion of ingredients 16 may be loaded into capsule 10, followed by an application of dosing agent 40 to form cluster 52 and then followed by the remainder of ingredients 16. It will be understood that the stations and process steps may be changed to allow for partial loading of ingredients 16, followed by dispensing of dosing agent, followed by loading of the remaining ingredients 16.

While the above description provides examples of one or more beverage capsules and processes for manufacturing same, it will be appreciated that other beverage capsules and processes may be within the scope of the accompanying claims.

We claim:

1. A process for making a capsule for use in a machine for preparing consumable products from capsules, the process comprising the steps of:

providing a body having an interior space and an opening;

depositing ingredients that are in a dry state into the interior space, the ingredients being adapted to form a consumable product when combined with fluid;

dispensing a dosing agent that is in a liquid state into the interior space; and sealing the opening with a cover, wherein said dosing agent is mixed with a gas prior to dispensing into said interior space.

2. A process according to claim 1 wherein a portion of said ingredients and said dosing agent are non-permanently bound into a cluster in said interior space.

3. A process according to claim 2 wherein said cluster is disposed at a location within said interior space that is adapted for controlling a flow of fluid that is injected into said capsule by the machine.

4. A process as claimed in claim 2 wherein said cluster is adapted to at least partially dissolve or break apart over a period of time within said capsule when exposed to a flow of fluid that is injected into said capsule by the machine.

5. A process as claimed in claim 2 wherein said cluster comprises a first region within said interior space and at least a portion of the remainder of said ingredients comprises a second region within said interior space.

6. A process as claimed in claim 5 wherein said second region at least partially surrounds said first region.

7. A process according to claim 1 wherein the dosing agent is dispensed under pressure.

8. A process as claimed in claim 1 wherein said dosing agent is dispensed over said ingredients that are disposed in said interior space.

9. A process as claimed in claim 1 wherein said dosing agent is dispensed into said interior space prior to said step of depositing said ingredients into said interior space.

10. A process according to claim 1 further comprising the step of providing a filter into said interior space for filtering at least a portion of said ingredients during preparation of said consumable product.

11. A process as claimed in claim 10 wherein said dosing agent is dispensed onto said filter prior to the step of depositing said ingredients into said interior space.

12. A process as claimed in claim 1 wherein said gas is an inert gas.

13. A process as claimed in claim 1 wherein said dosing agent is a neutral dosing agent that does not add any noticeable flavor, odour, sensory, health benefit or function to the consumable product produced from said capsule.

14. A process as claimed in claim 1 wherein said dosing agent includes an oil product.

15. A process for making a capsule for use in a machine for preparing consumable products from capsules, the process comprising the steps of:

providing a body having an interior space and an opening;

depositing ingredients that are in a dry state into the interior space, the ingredients being adapted to form a consumable product when combined with fluid;

dispensing a dosing agent that is in a liquid state into the interior space; and sealing the opening with a cover, wherein a portion of said ingredients are deposited into said interior space, said dosing agent is then dispensed into said interior space to form a cluster with said portion of ingredients and then the remainder of said ingredients are dispensed into said interior space.

16. A process according to claim 15 wherein the dosing agent is dispensed under pressure.

17. A process as claimed in claim 15 wherein said dosing agent is a neutral dosing agent that does not add any noticeable flavor, odour, sensory, health benefit or function to the consumable product produced from said capsule.

18. A process as claimed in claim 15 wherein said dosing agent includes an oil product.

19. A process for making a capsule for use in a machine for preparing consumable products from capsules, the process comprising the steps of:

providing a body having an interior space and an opening;

depositing ingredients that are in a dry state into the interior space, the ingredients being adapted to form a consumable product when combined with fluid;

mixing a dosing agent that is in a liquid state with a gas;

dispensing said mixture of dosing agent and gas into the interior space; and sealing the opening with a cover.

20. A process as claimed in claim 19 wherein said gas is an inert gas.

21. A process as claimed in claim 19 wherein said dosing agent is a neutral dosing agent that does not add any noticeable flavor, odour, sensory, health benefit or function to the consumable product produced from said capsule.

22. A process as claimed in claim 19 wherein said dosing agent includes an oil product.

23. A process according to claim 19 wherein the dosing agent is dispensed under pressure.

* * * * *